US006029468A

United States Patent [19]

Ferris et al.

[11] Patent Number: 6,029,468

[45] **Date of Patent: *Feb. 29, 2000**

[54] SNOW MAKING APPARATUS

[75] Inventors: Kevin S Ferris, Robertson; George H Jennings, Monash; Merrick E Watters, Deakin, all of Australia

[73] Assignee: Ski Trac International Pty Ltd., Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/839,141

[22] Filed: Apr. 23, 1997

[51] Int. Cl.[7] ..... F25C 3/04

[52] U.S. Cl. ..... 62/347; 239/2.2

[58] Field of Search ..... 62/74, 347; 239/2.2; 472/90

[56] References Cited

U.S. PATENT DOCUMENTS

| | | | |
|---|---|---|---|
| 4,345,439 | 8/1982 | Gundlach | 62/74 |
| 4,790,531 | 12/1988 | Matsui et al. | 239/2.2 |
| 5,230,218 | 7/1993 | Clucow | 62/74 |
| 5,272,883 | 12/1993 | Matsui et al. | 62/74 |
| 5,301,512 | 4/1994 | Yamamoto | 62/347 |
| 5,327,738 | 7/1994 | Morioka et al. | 62/74 |
| 5,445,320 | 8/1995 | Berthelier | 239/2.2 |

*Primary Examiner*—William E. Tapolcai
*Attorney, Agent, or Firm*—Pendorf & Cutliff

[57] ABSTRACT

A snow forming station is provided for making and/or maintaining snow on a ski slop constituted by a moveable base assembly which passes through the snow forming station. The snow forming station has a snow chamber surrounding a section of the moveable base assembly and a return air chamber through which a refrigerated air supply mean is recirculated. Snow making apparatus supplies snow to the chamber and snow carried in the return air is precipitated prior to return to the refrigeration apparatus.

12 Claims, 4 Drawing Sheets

SECTION A-B

SECTION C-D

SECTION E-F

SNOW MAKING APPARATUS

This invention has particular but not exclusive application to snow making apparatus for use in a warm climate, and for illustrative purposes reference will be made to such application. However, it is to be understood that this invention could be used in other applications, such as snow making apparatus in cold climates, including the provision of slopes with controlled snow coverage for training purposes. Additionally, while reference is made herein to use of snow covered slopes for skiing, it is to be understood that snow covering may be provided by this invention for other snow sports such as tobagganing, bob sledding and the like.

Conventional snow making equipment used for the manufacture of snow only operates successfully within a limited range of temperature and humidity. Most applications for such equipment are directed to the provision of artificial snow to supplement an inadequate supply of natural snow.

Indoor snow making equipment has been proposed for providing an artificial snow base inside an enclosed building. However, the maintenance of the integrity of the artificial snow base may be compromised unless ambient conditions inside the building are maintained below the freezing temperature of the snow. Additionally, the recycling of snow laden air may increase the difficulty in maintaining appropriate indoor climatic conditions.

The supply of a snow base in warmer climatic conditions or in controlled atmospheric conditions above freezing conditions also presents a problem in that a supply of fresh artificial snow is required to accommodate the melting of the snow in the warm conditions.

The present invention aims to alleviate one or more of the above disadvantages and to provide snow making apparatus which will be reliable and efficient in use.

With the foregoing in view, this invention in one aspect resides broadly in a snow forming station for making and/or maintaining snow on a moveable base assembly which passes through the snow forming station and including:

- a housing having a snow chamber surrounding a section of the moveable base assembly;
- a refrigerated air supply means for supplying air to the chamber; snow making apparatus for supplying snow to the chamber, and
- recirculating means for recirculating cold air from the chamber to the refrigerated air supply means.

Preferably, the refrigerated air supply means maintains frigid ambient conditions in the chamber to facilitate efficient operation of continuously operable snow making apparatus. It is also preferred that the temperature within the chamber be sufficiently low as to maintain a mean temperature of the snow bed below freezing.

The moveable snow base assembly may include a base assembly adapted for receiving and holding a covering of snow, and may be level or inclined. It is preferred, however, that the snow forming station be associated with a moveable base assembly which is inclined to the horizontal and that the snow making apparatus be arranged to supply snow from an elevated outlet position adjacent the end of the chamber through which the moveable base assembly exits the chamber. The refrigerated air supply may include frigid air inlets which together with the snow making apparatus may be arranged to direct inflow in a direction concurrent to the direction of movement of the snow bed. However, it is preferred that the frigid air inlets and the snow making apparatus be arranged to direct inflow of frigid air and/or snow in a counter-current direction to the direction of movement of the snow bed. Such air inlets may be positioned adjacent the downstream wall of the chamber to minimise leakage of cold air therefrom.

It is also preferred that the snow forming station be positioned to surround a downwardly moving section of an inclined moveable base assembly and that the snow chamber be formed with an upper wall or ceiling which converges with respect to the moveable base assembly in a direction away from the elevated outlet of the snow making apparatus.

Suitably, the recirculating means includes a relatively large return air flow chamber through which cold air expelled from the snow chamber may be recirculated to the refrigerated air supply means whereby suspended snow flakes will precipitate prior to entry of return air to the refrigerated air supply means. Precipitation is preferably induced by causing a change in the condition of the air in the return air chamber compared to the snow chamber such that most of residual snow carried over from the snow chamber with the air flow will precipitate in the return air chamber. This ensures that the efficiency of the heat exchange will not be adversely affected by snow build up on the heat exchange means which is suitably arranged to chill the air supplied thereto to sub-zero temperatures in the order of −1° C. to −20° C.

The change in condition may be a change in flow velocity of return air, achieved by forming the return air chamber as an expansion chamber such that air flow velocities fall after transfer from the snow chamber to the return air chamber. Preferably the return air chamber is a continuously expanding chamber and the heat exchange means is formed in the downstream end of the return air chamber.

Alternatively the change in condition in the return air chamber may be provided by filter and/or baffle means adapted to change air flow characteristics and extract residual snow, preferably without substantially impeding the flow of the return air. It is also preferred that the snow chamber be provided with cold-air barriers at the entrance to the moveable base assembly and exit from the snow chamber. These barriers may be in the form of hinged insulated panels, plastic curtain strips or air curtains.

In a further aspect, this invention resides broadly in sports apparatus including a moveable snow covered base assembly in the form of a moveable snow covered annular or oval track or the like and a snow forming station as variously described above positioned over a section of the track for making and/or maintaining snow on the moveable track. The latter may have an articulated surface comprised of a plurality of panels upon which snow may be deposited and moved in a continuous circuit. The continuous circuit may be any suitable shape and may include two parallel and inclined runs separated and operatively connected by two semiconductor end portions. Additionally, several circuits may be provided with downhill runs arranged in parallel.

The rate at which the base assembly moves is preferably within a range permitting users to ski down an upwardly moving inclined portion of the slope, and typically is in the order of from 5 km/hr to 20 km/hr at the outside edge. Suitably, the snow making apparatus includes control means providing a controlled output sufficient to make snow manufacture possible in the snow making chamber as well as for replenishing the snow base upon the snow base. Typically, a snow base includes a covering of snow to a depth in the order of 200 mm, and may typically be in the range of from 100 mm to 500 mm.

Suitably, the control means controls the speed and/or elevation of the moveable base assembly, the amount and/or quality of snow manufactured and the environment within the snow chamber. The control means may further include air blowers, air control surfaces, baffles and such like in order to control the flow of air within the snow making apparatus.

In yet a further aspect, this invention resides broadly in a method of forming a snow supply comprising:

forming an insulated snow chamber;

creating frigid conditions in the flow chamber with circulating frigid air;

utilizing a compressed air and water snow gun to create snow in the chamber; and collecting snow from the snow chamber.

The snow may be collected in batches but preferably it is collected continuously by forming the base wall of the snow chamber as a conveyer assembly. It is also preferred that the recirculated air be recirculated through a recirculation chamber which reduces the flow velocity of the return air to such extent that precipitation of snow in the return air is induced for batchwise collection.

In order that this invention may be more readily understood and put into practical effect, reference will now be made to the accompanying drawings which illustrate a typical embodiment of the invention and wherein.

Figure 1:
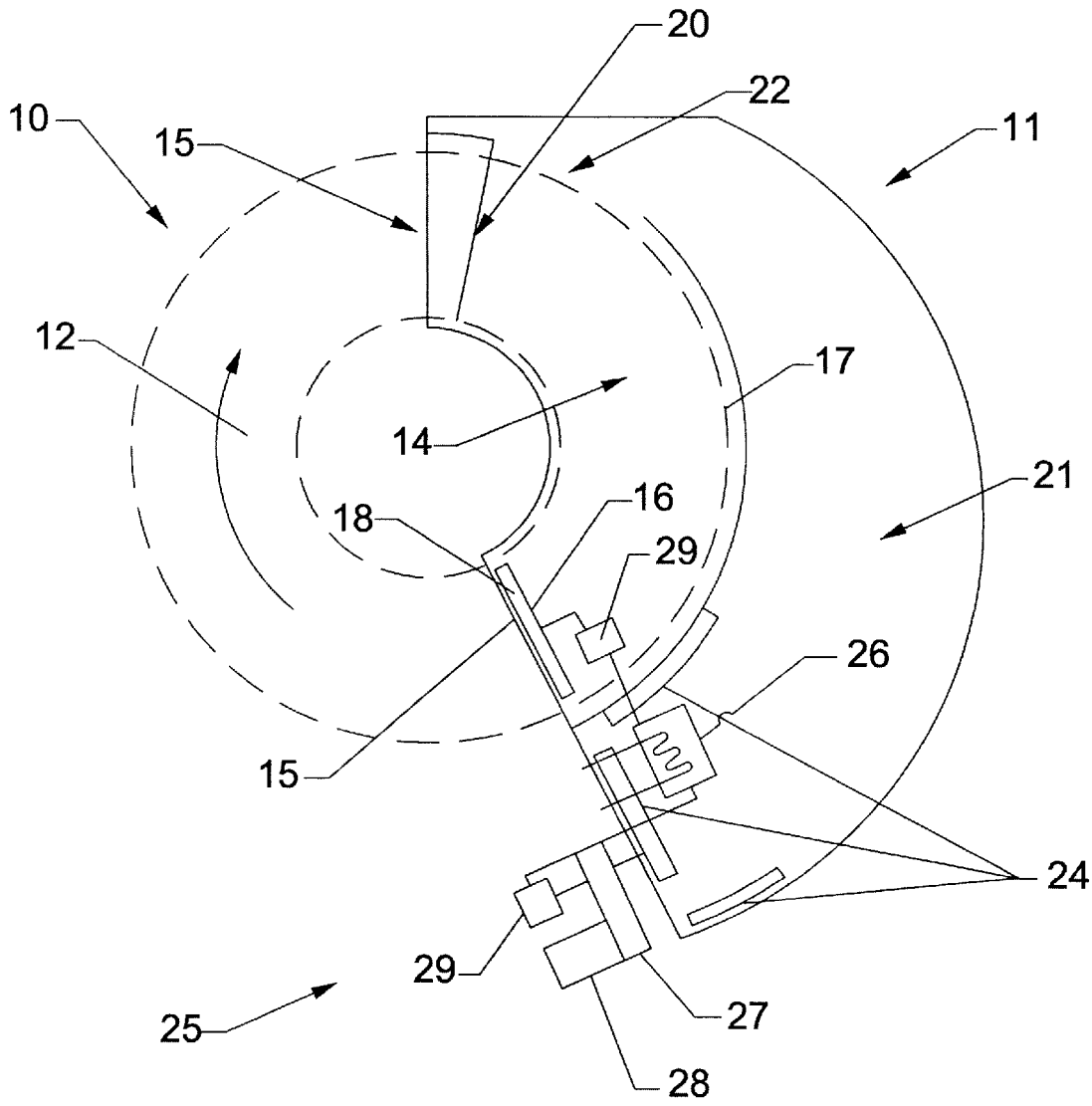
FIG. 1 is a diagrammatic top view of an artificial ski slop assembly and snow forming station.
Figure 3:
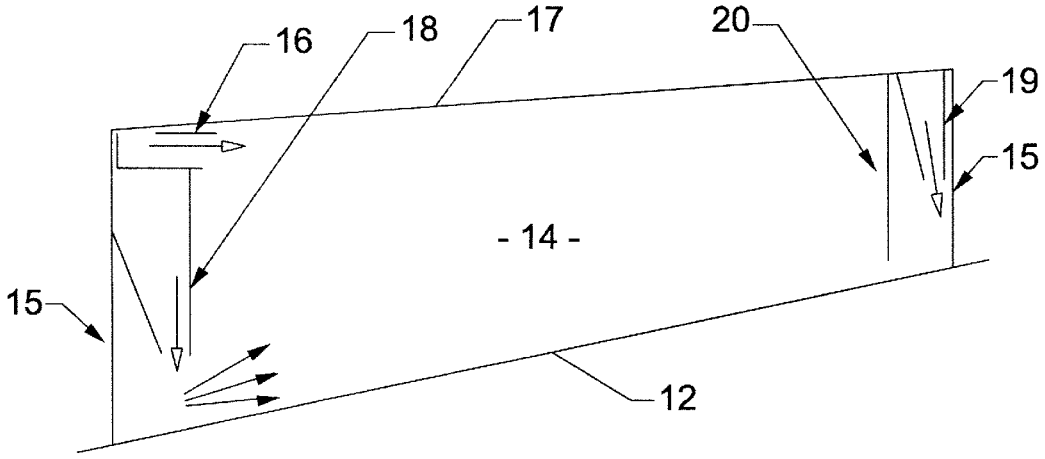
Figure 3:
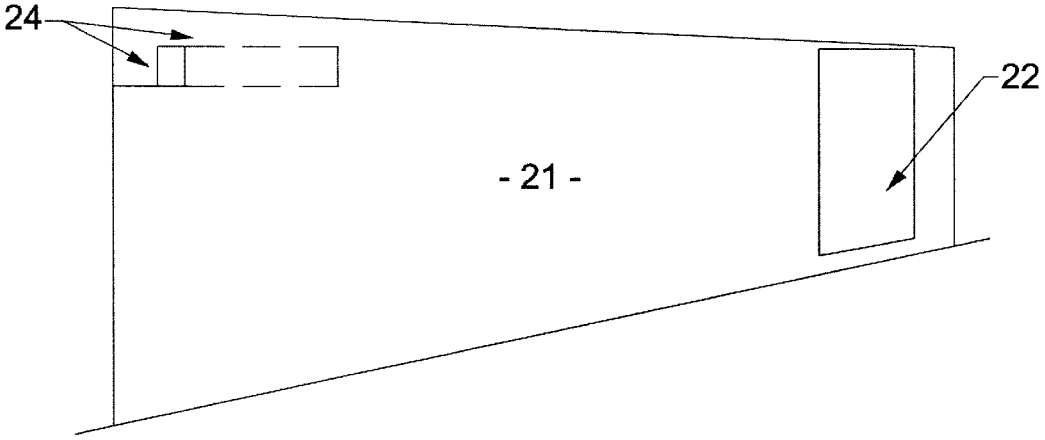
Figure 4:
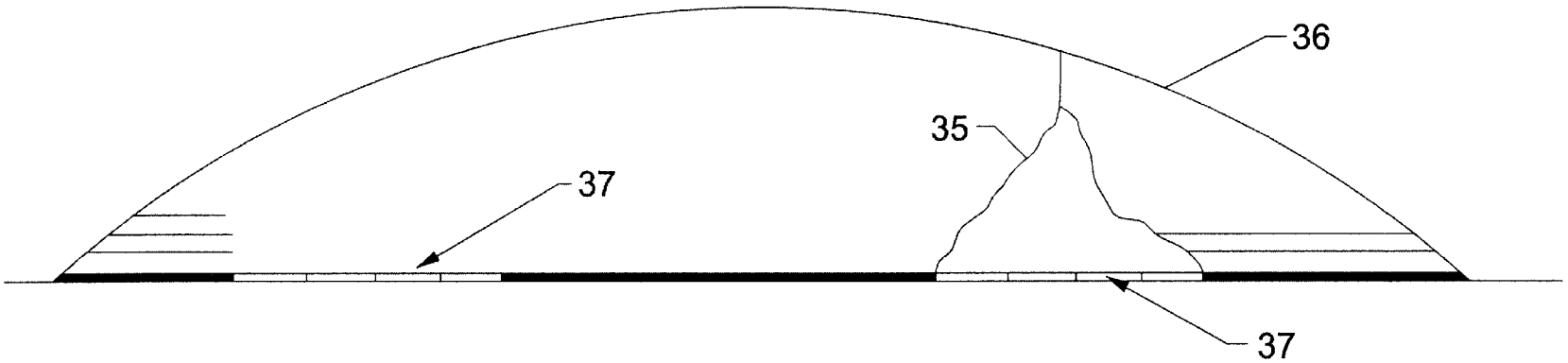

FIG. 3 collectively illustrates the sections A–B and C–D through the respective chambers of the snow forming station illustrated in FIG. 1; and FIG. 4 is a diagrammatic illustration of a further layout for a ski slope assembly and snow forming station.

The artificial ski slope assembly 10 and snow forming station 11 illustrated in FIGS. 1, 3 and 4 includes a disc-like snow deck 12 forming the back assembly of the snow forming station which is inclined and rotates clockwise as indicated by the directional arrow. The snow forming station 11 is disposed over the downwardly moving portion of the deck 12 and it includes an insulated snow chamber 14 which covers a portion of the deck 12 which forms a movable base wall of the chamber 14. The moving snow deck circulates through the open ends of the snow chamber. Cold air barriers 15 are provided to contain cold air in the insulated chamber 14. Leakage of cold air from the snow chamber is reduced by using cold air barriers 15 at each open end, as seen in FIG. 1, and by directing the primary incoming air through a primary air inlet 18 in a direction which opposes the movement of the deck.

The insulated snow chamber 14 is cooled by the use of the snow making apparatus which is a snow gun assembly 16 located at an elevated position therein and disposed above the lower end of the slope of the snow deck 12. The snow gun assemblies 16 are positioned to direct their jet of air and snow up the incline of the covered deck 12 beneath the top wall 17 which diverges upwardly towards the deck 12 such that the cross-sectional area of the chamber 14 diminishes away from the guns 16.

Frigid air is also supplied to the snow chamber 14 by the refrigeration apparatus. The frigid air is delivered partially through a primary air inlet 18 in the region of the snow guns 16 with the balance being directed through a downward facing secondary inlet 19 at the upper end of the chamber 14. Air inlets 18 and 19 are designated primary and secondary as a qualification of the amount of air admitted therethrough to the show chamber 14. Air inlet 18 admitting the greater amount of air and air inlet 19 admitting a smaller amount of air. The inlet 18 directs frigid air onto the deck 12 in a direction opposing the movement of the deck 12 such that it minimises loss of cold air dragged out of the chamber 14 with the moving deck 12. The secondary inlets 19 are located ahead of the barrier wall 20 to minimise warm air influx into the snow chamber 14. FIG. 3 shows an air flow direction with a component which opposes the through movement of the snow deck so as to minimize the air that is carried with the snow deck from the snow chamber 14. The directional air flow shown induces a circulation flow through the snow chamber 14 from the primary air inlet 18 to a vent 22.

The air flow from the primary air inlet 18, circulating within the snow chamber will be snow laden as it initially passes beneath the snow guns 16 whereupon the air flow will be heated by heat exchange with the snow which has been exposed on the deck 12 entering the snow chamber from the exterior. The heated, but still cold, is now spent air. A recirculation chamber 21 accepts the spent air flow from the insulated snow chamber 14 through a vent 22 disposed at the upper end of the chamber 14 below the barrier wall 20. The vent 22 has a variable opening variable between a maximum opening at which it does not restrict air flow through the insulated snow chamber 14 and a minimum opening at which the opening permits recycling of primary chamber air as in normal freezer room conditions. Make-up air is drawn into the primary chamber 14 after being suitably conditioned by the refrigeration apparatus 25, which has evaporator coils and a fan located within the recirculation chamber 21. Air may also be exhausted through an air exhaust 24 to control the refrigeration process.

The spent air that passes through the vent 22 resulting in an air flow velocity reduction within the recirculation chamber such that entrained snow falls from the slower moving air onto the floor of the recirculation chamber before the air is again chilled by the evaporator coils and forced by one of the fans 29 into the snow chamber 14. Also, the volume of the recirculation chamber 21 is greater than that of the insulating snow chamber 14 wherein return air velocities are lowered to ensure settlement of residual snow particles prior to the air being recycled through evaporator coils 26 of the refrigeration apparatus 25 whereby the recirculation chamber creates suitable intake air for the evaporator coils 26. The evaporator coils 26 form part of a conditioning assembly which may include humidity control apparatus 27, regenerator apparatus 28 for the humidity control apparatus 27, and/or fans 29 which may be provided in either or both positions shown in FIG. 1.

Under conditions of snow maintenance, the vent 22 is closed down to approximately one tenth its opening and air is recycled as in normal freezer room conditions. Make-up air is drawn into the system through external air inlets and conditioned by heat exchangers before being injected into the recirculation chamber 21. Process control of the snow chamber refrigeration is possible, such as by computer supervision, to provide the temperature balance necessary for the maintenance of a below zero snow base temperature.

Figure 2:
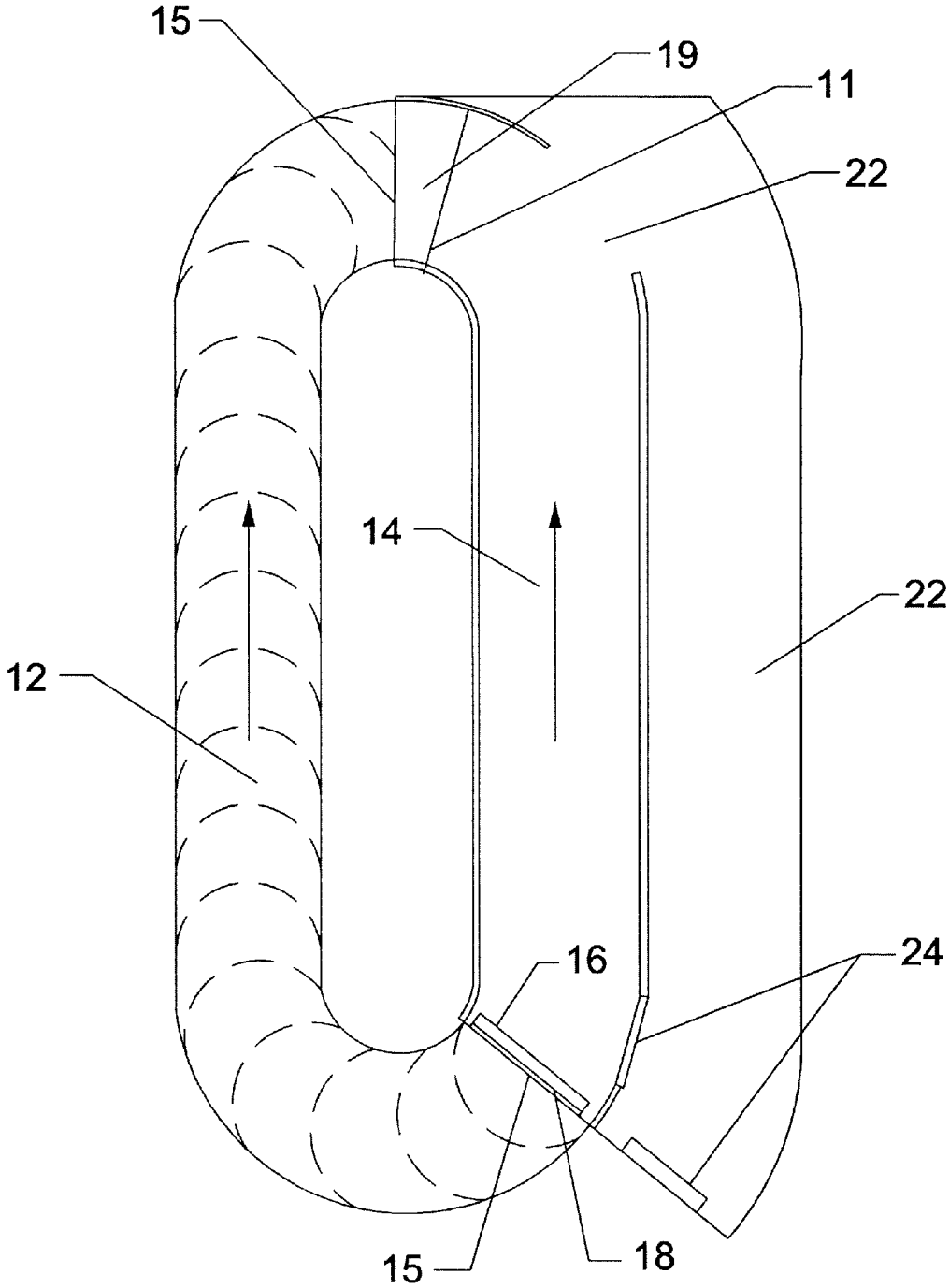
FIG. 2 is a diagrammatic top view of an alternative ski slope assembly and snow forming station.

Thus the snow deck 12 is continuously conveyed through the snow chamber 14 in either the configuration of FIG. 1 or FIG. 2 to form a snow deck outside of the insulating snow chamber 14 in an area of warm ambient temperatures which may be skied upon.

Suitably, the primary air inlet 18 is equipped with direction vanes to feed the incoming air into the chamber against the outward flow of snow. It is believed that this will minimise loss of refrigerated air from the chamber exit.

The circular deck 12 may range in diameter from 15 to 150 meters and more and the width of the deck may range from 3 meters to over 40 meters and in the later case associated with a chamber 14 which spans the full width of the deck and has a consistent height of 8 meters or more.

Residual snow retained in the recirculation chamber may be used in a snow-play area, as stored back-up snow for the deck, or as a toboggan run and/or additional ski slope as desired.

The apparatus of this invention may be used to extend the use of snow-making equipment for specific applications, such as in a chamber designed to create suitable conditions for the manufacture and retention of skiable snow in warm environments. The snow-making chamber duplicates suitable conditions by providing a frigid atmospheric system suited to the specific requirements of continuous use of snow-making equipment. The snow chamber may also be used to produce snow continuously for the purpose of conveying the snow by any means to a desirable slope remote from the chamber. This may be by means of a conveyor belt system through the chamber to a point where machinery with scraper blade or any other transport mechanism may deliver the snow to the required site. Furthermore, ski track grooming means such as a fixed dozer blade and or surface raking apparatus may be provided to groom the skiing surface during transit through the snow chamber 14.

Suitably, the snow chamber 14 and the recirculated chamber 21 are formed in the manner of cold rooms and the like. However, if desired, the snow chamber and the return air chamber may be housed within an artificial mountain 35 as illustrated in FIG. 4 which may be located within a dome 36 extending over entire ski deck 37. The artificial mountain may be covered with snow extracted from the return air chamber if desired.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

We claim:

1. A snow forming station for making and/or maintaining snow on a movable base assembly which passes through the snow forming station and including:

a base assembly moveable in a loop;

a housing having a snow chamber and a return air flow chamber, the snow chamber surrounding a moving section of the moveable base assembly;

a refrigerated air supply means for supplying refrigerated air to the snow chamber of the housing;

a snow making apparatus for supplying snow to the moving section within the snow chamber, the snow making apparatus being located at an elevated outlet position within the snow chamber; and a recirculating means for recirculating cold air from the return air flow chamber to the refrigerated air supply means and for reconditioning the air to cause entrained snow to precipitate prior to the air returning to the snow chamber.

2. The snow forming station as defined in claim 1, wherein the refrigerated air supply means maintains frigid ambient conditions in the chamber to facilitate efficient operation of a compressed air and water snow making apparatus.

3. The snow forming station as defined in claim 2, wherein the moveable snow base assembly is inclined to the horizontal and the snow making apparatus is arranged to supply snow from the elevated outlet position adjacent the end of the chamber through which the moveable base assembly exits the chamber.

4. The snow forming station as defined in claim 3, wherein the refrigerated air supply includes a frigid air inlet which direct inflow of frigid air in a counter-current direction to the direction of movement of the snow base assembly.

5. The snow forming station as defined in claim 4, wherein the snow forming station is positioned about a downwardly moving section of an inclined moveable base assembly.

6. The snow forming station as defined in claim 5, wherein the snow chamber be formed with an upper wall or ceiling which converges with respect to the moveable base assembly in a direction away from an elevated outlet of the snow making apparatus adjacent the lower end of the snow chamber.

7. The snow forming station as defined in claim 6, wherein the recirculating means includes a relatively large return air flow recirculation chamber through which cold air expelled from the snow chamber is recirculated at a reduced velocity.

8. The snow forming station as defined in claim 7, wherein the recirculating means includes a return air chamber which expands from its junction with said snow chamber.

9. A sports apparatus including a moveable snow covered base assembly in the form of a moveable annular or oval track or the like and a snow forming station as defined in claim 1 and positioned over a section of the track.

10. The snow forming station as defined in claim 1, wherein the snow chamber has a pair of cold air barriers, one cold air barrier being at the entrance where the moveable base assembly enters the housing, and the other of the cold air barriers being at the exit where the moveable base assembly exits the housing.

11. The snow forming station as defined in claim 1, wherein the return air flow chamber has a vent disposed along the top wall of the snow chamber and adjacent a barrier wall of the snow chamber for allowing spent air to flow into the recirculation means.

12. The snow forming station as defined in claim 3, wherein the snow making apparatus is a snow gun assembly disposed above the downwardly moving section of the moveable base assembly, the snow gun assembly is positioned to direct a jet of air and snow up the incline of the movable base assembly entering into the snow chamber.

* * * * *